US010177506B2

(12) United States Patent
Chereson

(10) Patent No.: US 10,177,506 B2
(45) Date of Patent: Jan. 8, 2019

(54) CONNECTING CONDUCTOR

(71) Applicant: API Technologies Corporation, State College, PA (US)

(72) Inventor: Jeffrey D. Chereson, Erie, PA (US)

(73) Assignee: API Technologies Corporation, Marlborough, MA (US)

( * ) Notice: Subject to any disclaimer, the term of this patent is extended or adjusted under 35 U.S.C. 154(b) by 0 days.

(21) Appl. No.: 15/669,919

(22) Filed: Aug. 5, 2017

(65) Prior Publication Data

US 2018/0040991 A1 Feb. 8, 2018

Related U.S. Application Data

(60) Provisional application No. 62/371,705, filed on Aug. 5, 2016.

(51) Int. Cl.

| | |
|---|---|
| ***H01R 13/66*** | (2006.01) |
| ***H01R 13/04*** | (2006.01) |
| ***H01R 13/03*** | (2006.01) |
| ***H01C 1/012*** | (2006.01) |
| ***H01C 17/06*** | (2006.01) |
| ***H01C 1/022*** | (2006.01) |
| ***H01C 1/14*** | (2006.01) |
| *H01C 17/065* | (2006.01) |
| *H01R 13/696* | (2011.01) |

(52) U.S. Cl.

CPC ..... *H01R 13/6616* (2013.01); *H01C 1/012* (2013.01); *H01C 1/022* (2013.01); *H01C 1/14* (2013.01); *H01C 17/06* (2013.01); *H01R 13/035* (2013.01); *H01R 13/04* (2013.01); *H01C 17/0652* (2013.01); *H01R 13/696* (2013.01)

(58) Field of Classification Search

CPC ..... H01R 13/6616
USPC ..... 439/620.21; 338/220
See application file for complete search history.

(56) References Cited

U.S. PATENT DOCUMENTS 3,107,179 A * 10/1963 Kohring ..... H01B 1/00 118/47
3,111,641 A * 11/1963 Wilentchik ..... H01R 13/6616 338/221
3,740,701 A * 6/1973 Harnden, Jr. ..... H01C 7/102 338/21
3,778,752 A * 12/1973 Noyes ..... G01R 1/06 338/220
3,988,639 A * 10/1976 Preiser ..... G04C 15/00 338/220

(Continued)

*Primary Examiner* — Neil Abrams
(74) *Attorney, Agent, or Firm* — Hodgson Russ LLP

(57) ABSTRACT

A connecting-conductor is disclosed. The connecting-conductor may have a first conductor-element and a second conductor-element. Each conductor-element has a first end that is mechanically-connected and electrically-conductively connected to a resistor-element. The resistor-element has an electrical-insulating substrate, and a resistive material annularly disposed on at least part of the electrical-insulating substrate. The first end of each conductor-element is electrically-conductively connected to the resistive material. The first conductor does not touch the second conductor, and an electrical pathway is created via the resistive material from one of the conductor-elements to the other of the conductor-elements.

30 Claims, 6 Drawing Sheets

(56) References Cited

U.S. PATENT DOCUMENTS

| | | | | | |
|---|---|---|---|---|---|
| 4,050,053 | A * | 9/1977 | Francis | H01C 1/142 | 338/272 |
| 4,575,694 | A * | 3/1986 | Lapke | H01R 24/46 | 200/51.1 |
| 4,772,225 | A * | 9/1988 | Ulery | H01R 13/7195 | 29/854 |
| 4,774,491 | A * | 9/1988 | Vugts | H01C 7/006 | 338/306 |
| 5,167,537 | A * | 12/1992 | Johnescu | H01R 13/6666 | 333/185 |
| 6,097,117 | A * | 8/2000 | Pivrnec | H01R 29/00 | 310/71 |
| 8,353,713 | B2 * | 1/2013 | Hofer | H01R 13/187 | 439/181 |
| 8,602,821 | B2 * | 12/2013 | Fujisaki | H01R 43/20 | 439/606 |
| 9,362,687 | B1 * | 6/2016 | Ju | H01R 13/665 | |
| 9,583,892 | B2 * | 2/2017 | Chatain | H01R 13/6666 | |
| 2012/0077382 | A1 * | 3/2012 | De Orleans E Braganca | H01R 4/56 | 439/620.21 |

* cited by examiner

CONNECTING CONDUCTOR

CROSS-REFERENCE TO RELATED APPLICATION

This application claims the benefit of priority to U.S. provisional patent application Ser. No. 62/371,705, filed on Aug. 5, 2016.

FIELD OF THE INVENTION

The present invention generally relates to devices, systems, and methods of transmitting electricity. More specifically, the present invention may relate to devices, systems, and methods of placing a resistor between two electricity conductors.

BACKGROUND OF THE INVENTION

In the prior art, electromagnetic energy conductors ("EE Conductors"), such as those that carry electricity, are used to carry electromagnetic energy from one device to another. For example, a signal may be sent in the form of electricity from one circuit board via an EE Conductor to another circuit board. Or, a signal may be sent in the form of electromagnetic energy from a controller to an actuator that activates a motor.

Such EE Conductors are often joined together using a prefabricated plug and socket that mate together. There are a number of commonly used mechanisms used to hold the plug and socket in their mated positions (that is to say held relative to each other). One such mechanism is a threaded connection wherein a housing associated with the plug and a housing associated with the socket each have a threaded surface, and by turning one of the housings relative to the other, these threaded surfaces may be mated together such that the housings, and therefore the plug and socket, are held together.

Another such mechanism utilizes one or more screws, each of which extends through the housing of the socket and the housing of the plug. In such a mechanism, one or both of housings may have a threaded surface to which the threads of the screw are mated, or it is possible that the screw may be held in place by a threaded nut.

A third such mechanism relies on the plug and socket housing being mated together, and then one or both of the housings is deformed (a.k.a. crimped) such that the socket housing is unable to be separated from the plug housing, except by reversing the effect of the deformation.

Other mechanisms for holding the plug and socket in their mated positions are possible. Regardless of the type of mechanism, the plug housing and the socket housing have a predetermined structure and the dimensions are carefully planned so that the features of the plug and socket that carry the electromagnetic energy from one EE Conductor to the other EE Conductor are brought into contact when the plug and socket housings are mated. Such features of the plug and socket that carry the electromagnetic energy are often mating pins and sockets that are brought together in a conductive relationship, so as to conduct the electromagnetic energy, when the plug housing is mated with the socket housing. It is often the case that the predetermined structure and planned dimensions of the plug and socket housings are such that there is very little available space within the housings once they are mated. Consequently, additional components cannot be included within the housings without redesigning the housings.

In addition, the EE Conductors along with the mating plug and sockets that join them are often part of a larger system that mandates and restricts the size and placement of the EE Conductors, plugs, and sockets. For example, when such EE Conductors are used in vehicles, such as cars or airplanes, the location of a particular plug and socket is normally planned somewhat precisely so as not to interfere with other systems on the vehicle, or interfere with a desired use of the vehicle, or to facilitate manufacturing of the vehicle. As such, redesigning the plug and socket housings may necessitate the redesign of other systems and/or components. Consequently, redesigning plugs and sockets is to be avoided.

Vehicles, such as cars or airplanes, utilizing EE Conductors may need to be modified to meet changing safety standards or to bring a system that is on the vehicle into compliance with existing safety standards in ways that were previously not anticipated. For example, the manufacturer of an airplane may decide that additional protection of its electromagnetic systems is needed in order that the electromagnetic systems are better protected from lightning strikes. In order to provide that protection it would be desirable to quickly and cheaply add a resistor to the electromagnetic systems of the airplane. An ideal location for adding such a resistor would be at the junction between two EE Conductors. However, given the restrictions discussed above, currently it would be neither quick nor cheap to add a resistor to the features contained within the plug and socket housings.

SUMMARY OF THE INVENTION

The invention may be embodied as a connecting-conductor having a first conductor-element and a second conductor-element. Each conductor-element has a first end that is mechanically-connected and electrically-conductively connected to a resistor-element. The resistor-element has an electrical-insulating substrate, and a resistive material annularly disposed on at least part of the electrical-insulating substrate. The first end of each conductor-element is electrically-conductively connected to the resistive material. The first conductor does not touch the second conductor, and an electrical pathway is created via the resistive material from one of the conductor-elements to the other of the conductor-elements.

The resistor-element may include a conductive material that is:

(a) annularly disposed on at least part of the electrical-insulating substrate; and (b) electrically-conductively and mechanically-connected to one of the conductor-elements and to the resistive material.

The resistor-element may include a conductive material that is:

(a) annularly disposed on at least part of the electrical-insulating substrate; and (b) electrically-conductively and mechanically-connected to one of the conductor-elements and to the resistive material.

The resistor-element may include a conductive material that is annularly disposed on at least part of the electrical-insulating substrate to provide a conductive pathway between the first conductor-element and the resistive material.

The resistor-element may include:

(a) a conductive material at a first location that is electrically-conductively and mechanically-connected to the first conductor-element and to the resistive material; and (b) a conductive material at a second location that is electrically-conductively and mechanically-connected to the second conductor-element and to the resistive material.

The resistor-element may have a first surface defining a receiving-hole, and the first end of the first conductor-element or the first end of the second conductor-element may reside in the receiving-hole.

The resistor-element may have a first surface defining a receiving-hole, and the first end of the first conductor-element or the first end of the second conductor-element may reside in the receiving-hole. In such an embodiment:

(a) the first conductor-element may reside in the receiving-hole, and the resistor-element may further have a second surface defining another receiving-hole in which the first end of the second conductor-element resides; or (b) the receiving-hole may extend through the resistor-element, and the first end of the first conductor-element may reside in a first part of the receiving-hole, and the first end of the second conductor-element may reside in a second part of the receiving-hole; or (c) the first end of the first conductor-element may reside in the receiving-hole, and the first end of the second conductor-element may have a surface defining a hole in which part of the resistor-element resides.

The first end of the first conductor-element may have a surface defining a hole in which a first part of the resistor-element resides, and the first end of the second conductor-element may have a surface defining a hole in which a second part of the resistor-element resides.

The electrical-insulating substrate may be a ceramic material, a plastic material, or a polymer material.

The electrical-insulating substrate may be material selected from the group consisting of: porcelain, alumina, steatite, titanate, and glass.

The resistive material may be selected from the group consisting of: carbon and a carbon composition.

At least one of the conductor-elements may be a material selected from the group consisting of: copper, copper alloy, steel, aluminum, and aluminum alloy.

The first conductor-element and/or the second conductor-element may be solid.

The first conductor-element and/or the second conductor-element may have a tubular portion or may be tubular from end to end.

The conductive material may be selected from the group consisting of: copper, copper alloy (such as bronze or brass), tin, tin alloy, aluminum, aluminum alloy, gold, nickel, and silver.

BRIEF DESCRIPTION OF THE DRAWINGS

For a fuller understanding of the nature and objects of the invention, reference should be made to the accompanying drawings and the subsequent description. Briefly, the drawings are.

FURTHER DESCRIPTION OF THE INVENTION

Figure 1:
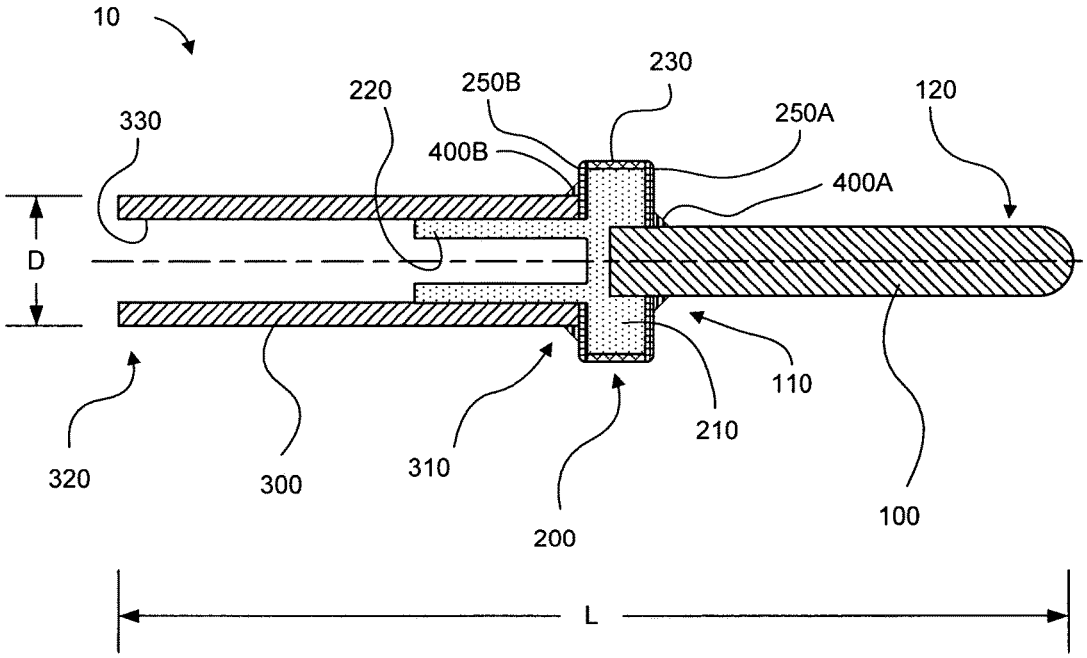
FIG. 1 is a cross sectional view of a first embodiment of a connecting-conductor that is in keeping with the invention.
Figure 2:
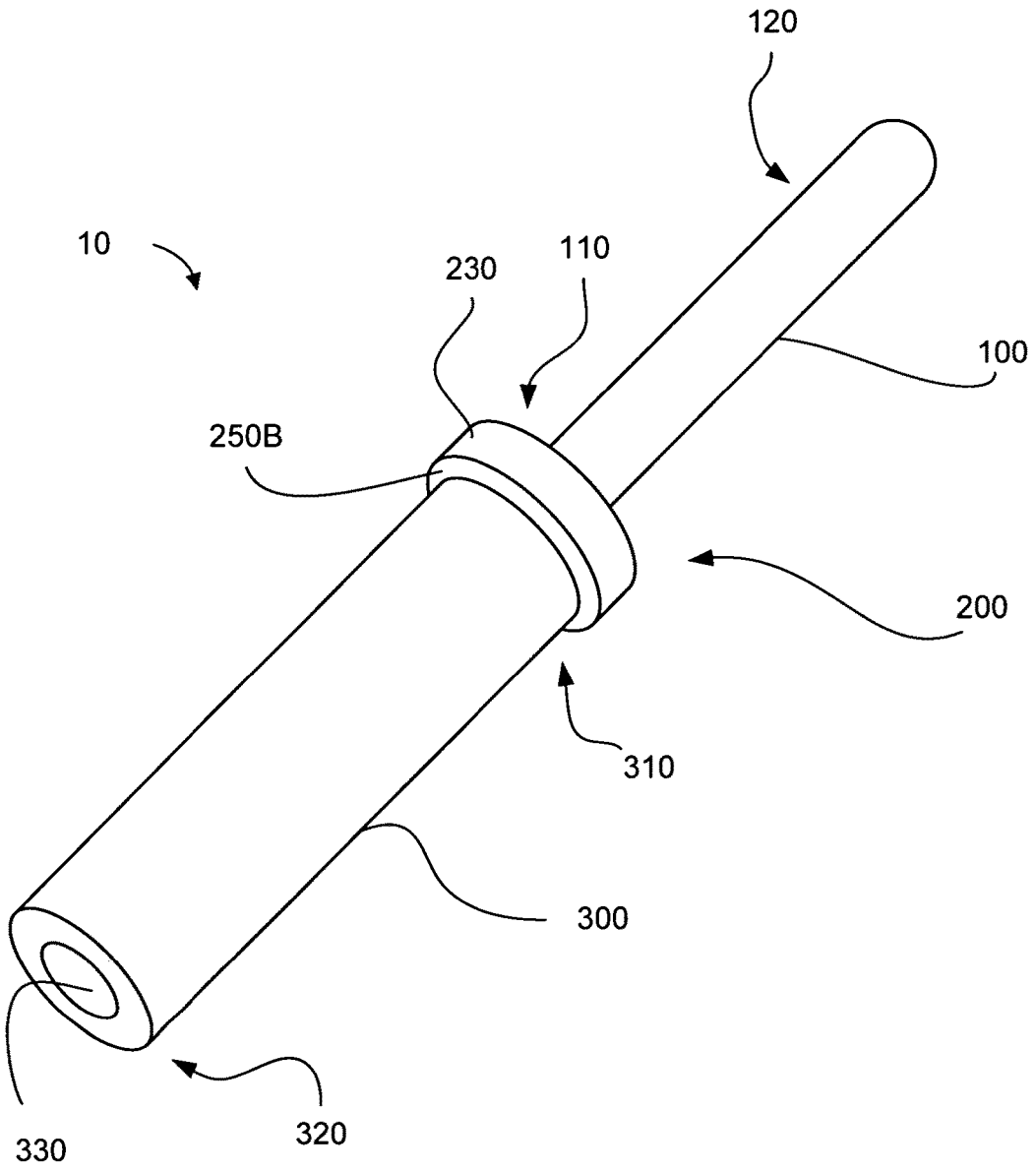
FIG. 2 is a perspective view of the connecting-conductor depicted in FIG. 1.

FIG. 1 and FIG. 2 depict a connecting-conductor 10 that may be used within the housings of a plug and socket to place a resistor between two EE Conductors. In FIG. 1 and FIG. 2 there is a shown a first conductor-element 100 in the shape of a pin, a second conductor-element 300 in the shape of a socket, and these conductor-elements 100, 300 are joined together by a resistor-element 200. The overall length L and diameter D of the connecting-conductor 10 may be selected to be the same or very similar to the length and diameter of the existing pin or socket that is brought together in a conductive relationship when the plug housing is mated with the socket housing.

The resistor-element 200 depicted in FIG. 1 as having an electrical-insulating substrate 210 and a resistive material 230 that is annularly disposed on at least part of the electrical-insulating substrate 210. A first end 110 of the first conductor-element 100 is mechanically-connected to the resistor-element 200, and electrically-conductively connected to the resistive material 230 via a first conductive material 250A that is annularly disposed on at least part of the electrical-insulting substrate 210. In a similar manner, a first end 310 of the second conductor-element 300 is mechanically-connected to the resistor-element 200, and electrically-conductively connected to the resistive material 230 via a second conductive material 250B that is annularly disposed on at least part of the electrical-insulting substrate 210. In this manner, the first conductor-element 100 does not touch the second conductor-element 300, and an electrical pathway is created via the resistive material 230 from one of the conductor-elements 100, 300 to the other of the conductor-elements 300, 100. And, the second ends 120, 320 of the conductor-elements 100, 300 are depicted as being available for joining to other components. For example, the second end 320 of conductor-element 300 may be joined to an EE Conductor, and the second end 120 of the conductor-element 100 may be mated with a socket conductor that resides within one of the plug or socket housings. For clarity, if the connecting-conductor 10 shown in FIGS. 1 and 2 is associated with a plug housing, then the corresponding socket housing would contain a socket that mates with the second end 120 of conductor-element 100 when the plug housing and the socket housing are mated. Alternatively, if the connecting-conductor 10 shown in FIGS. 1 and 2 is associated instead with a socket housing, then the corresponding plug housing would contain a socket that mates with the second end 120 of conductor-element 100 when the plug housing and the socket housing are mated.

The conductive material 250A, 250B is shown in FIGS. 1 and 2 annularly disposed on at least part of the electrical-insulating substrate 210. Each of the conductive materials 250A, 250B is also shown in FIGS. 1 and 2 electrically-conductively and mechanically-connected to one of the conductor-elements 100, 300 as well as to the resistive material 230. In this manner, an electrical pathway is created via the resistive material 230 from one of the conductor-elements 100, 300 to the other of the conductor-elements 300, 100.

It should be noted that the word "annularly" is used herein to identify not only rings of material that are substantially circular, but other shapes as well. For example, if the electrical-insulating substrate 210 is triangular, or square, or oval shaped, then the annularly disposed conductive material 250A, 250B as well as the resistive material 230 may have a corresponding triangular, or square, or oval shape too. Thus, the word "annularly" is used herein in a manner that is broader than its tradition definition to refer to shapes other than circular rings.

The mechanical and electrical connection between the conductor-elements 100, 300 and the conductive material 250A, 250B of the resistor-element 200 may be achieved by placing beads 400A, 400B (such as that shown in FIG. 1) of conductive solder or conductive epoxy where the conductor-elements 100, 300 are close to their corresponding conductive-material 250A, 250B, and allowing that bead to harden. However, the mechanical connection between the conductor-elements 100, 300 and the resistor-element 200 may be achieved or augmented in other ways. For example, a non-conductive epoxy may be used to join the conductor-elements 100, 300 directly to the electrical-insulting substrate by applying the epoxy to those surfaces of the conductor-elements 100, 300 and/or to the electrical-insulating substrate 210 that are placed in close proximity to each other during formation of the connecting-conductor 10.

Figure 3A:
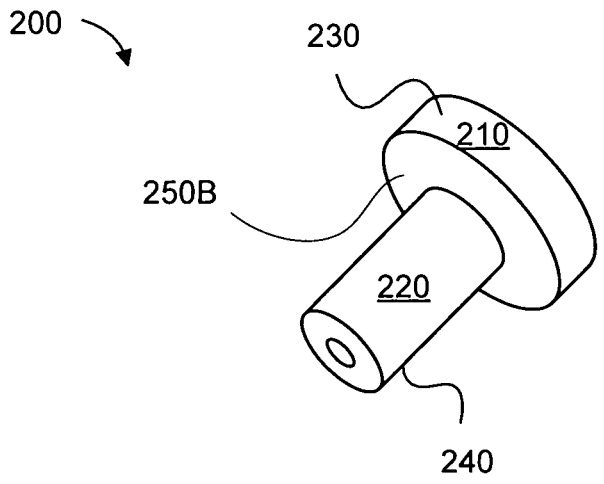
FIG. 3A is a perspective view of a resistor element that is in keeping with the invention.
Figure 3B:
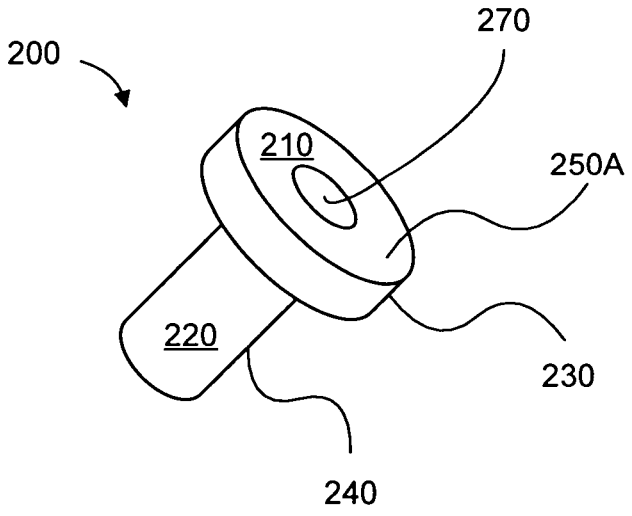
FIG. 3B is a different perspective view of the resistor element depicted in FIG. 3A.

The mechanical connection between the conductor-elements 100, 300 and the electrical-insulating substrate 200 may be strengthened by providing one or more legs that extend into a conductor-element. For example, FIG. 1 shows such a leg 220 (see also FIGS. 3A and 3B) extending into the first end 310 of the second conductor-element 300. The second conductor-element 300 has an internal surface 330 into which the leg 220 extends and resides.

Figure 4A:
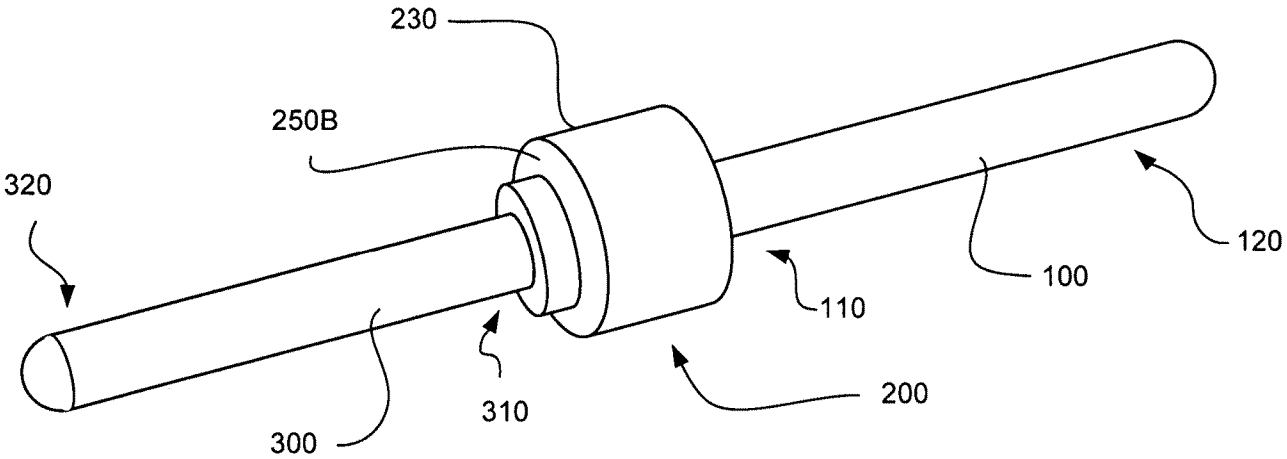
FIG. 4A is a perspective view of a second embodiment of a connecting-conductor that is in keeping with the invention.
Figure 4B:
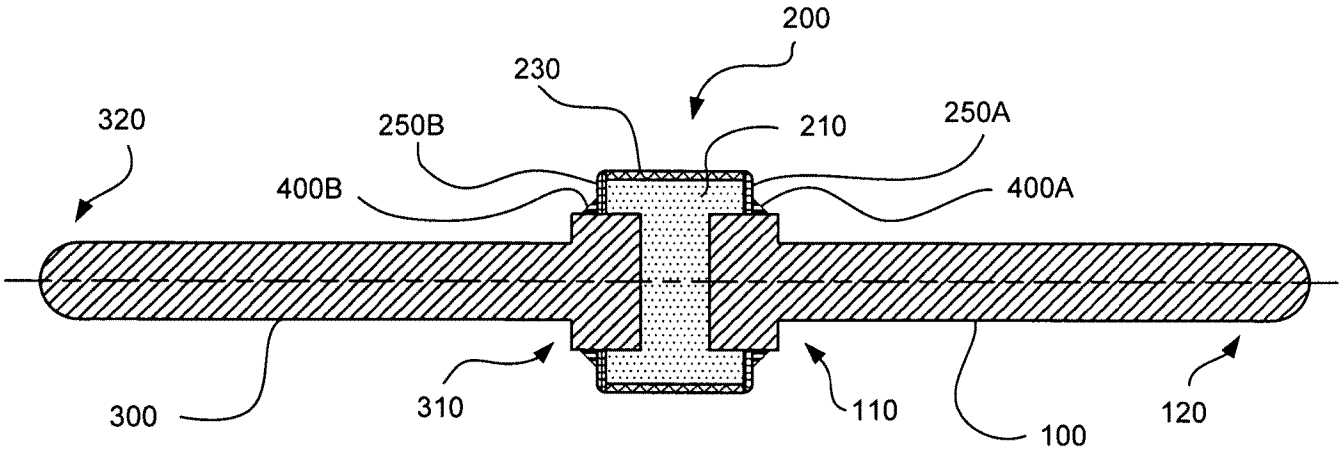
FIG. 4B is a cross sectional view of the connecting-conductor depicted in FIG. 4A.

The mechanical connection between the conductor-elements 100, 300 and the electrical-insulating substrate 200 may be strengthened by providing one or more receiving holes in the electrical-insulating substrate 200, such as the partial receiving hole 270 (see FIG. 3B) that is shown in FIG. 1 accepting the first end 110 of the first conductor-element 100. Other arrangements are possible. For example, FIGS. 4A and 4B depict an embodiment of the invention in which the electrical-insulating substrate 210 has two receiving holes (each a partial hole), one receiving hole for receiving the first end 110 of the first conductor-element 110, and another receiving hole for receiving the first end 310 of the second conductor-element 310.

Figure 4C:
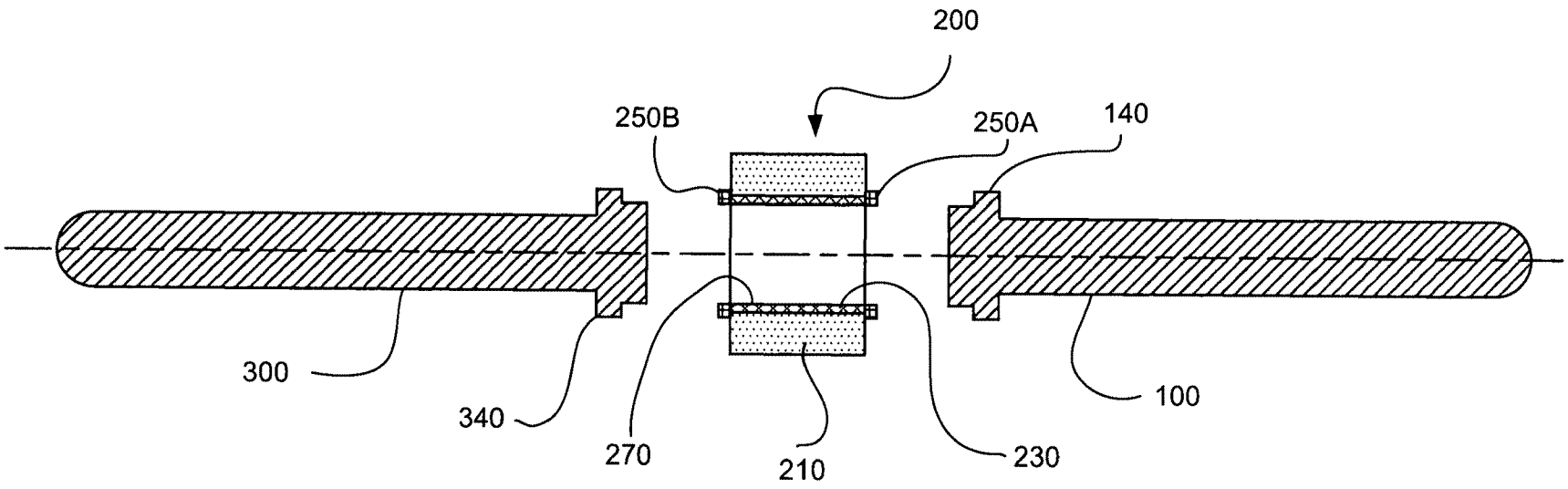
FIG. 4C is an exploded cross sectional view of a third embodiment of a connecting-conductor that is in keeping with the invention.

FIG. 4C depicts another embodiment of the invention in which the electrical-insulating substrate 210 has a receiving hole 270 that extends through the electrical-insulating substrate 210. Annularly applied to the surface defining that receiving hole 270 is the resistive material 230. When assembled, the shoulders 140, 340 of the conductor-elements 100, 300 touch and/or are electrically connected to the conductive material 250A, 250B.

Figure 5A:
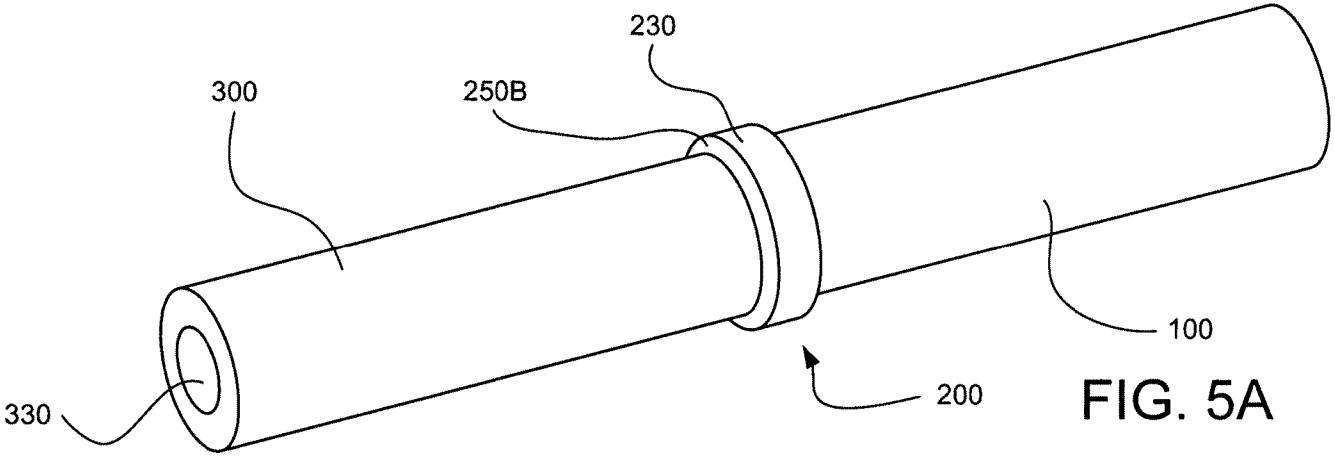
FIG. 5A is a perspective view of a fourth embodiment of a connecting-conductor that is in keeping with the invention.
Figure 5B:
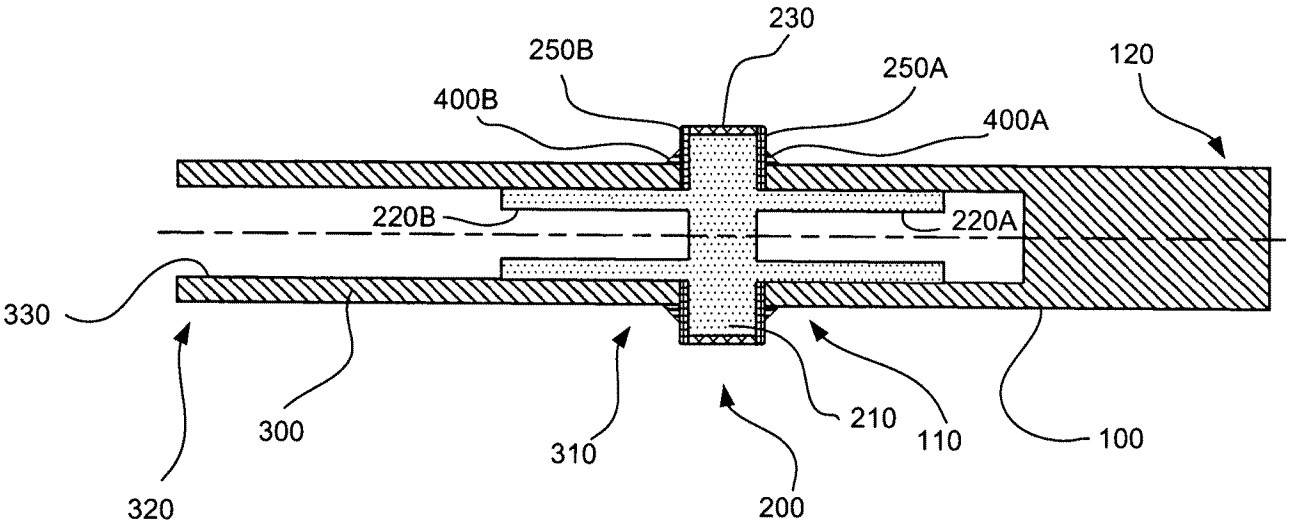
FIG. 5B is a cross sectional view of the connecting-conductor depicted in FIG. 5A.

FIGS. 5A and 5B depict another embodiment of the invention in which legs 220A, 220B of the electrical-insulating substrate 210 extend into the conductor-elements 100, 300. Note that the conductor-elements 100, 300 shown in FIG. 5B are different types. The conductor-element 300 is a tube from end 310 to end 320, whereas the conductor-element 100 is not a full tube and instead has a portion that is tubular in the vicinity of end 110. This need not be the case, for example, the connecting-conductor 100 shown in FIG. 5B may be replaced with a full-tube type so that the types of connecting-conductors are the same type. For emphasis of this idea, the conductor-elements 100, 300 may be the same type (e.g. see FIGS. 4B and 4C), or different types (e.g. FIGS. 1 and 5B). Throughout the figures, there are shown various types of conductor-elements, and it should be noted that such types are not necessarily limited to use in the particular embodiments depicted. For example, the partial-tube type shown in FIG. 5B for the conductor-element 100 could be used in the embodiment of FIG. 1 as the conductor 300.

The resistor-element 200 may be formed by applying the conductive material 250A, 250B to the electrical-insulating substrate 210, for example by spraying or dipping procedures, and the resistive material may be applied to the electrical-insulating substrate 210 by similar procedures. The effective resistance of the resistor-element 200 may be selected by varying the amount of conductive material 250A, 250B and resistive material 230 used, while maintaining a desired thicknesses of those materials.

It is worth noting that the particular arrangement shown in the figures are not the only viable arrangements. For example, the locations of the conductive materials and the resistive material may be reversed. That is to say for example that the area identified in FIG. 1 by "230" may be a conductive material, and the areas identified in FIG. 1 by "250A" and "250B" may be the resistive material.

The electrical-insulating substrate 210 may be a ceramic material, a plastic material, a polymer material having the ability to electrically insulate one electrically conductive substance from another. For example, the electrical-insulating substrate 210 may be porcelain, alumina, steatite, titanate, and/or glass. The resistive material 230 may be carbon, a composition of carbon, or other materials that resist but do not prevent the transmission of electricity. The conductor-elements 100, 300 may be copper, copper alloy (such as bronze or brass), steel, aluminum, aluminum alloy, as well as other conductive substances. The conductive material 250A, 250B may be copper, copper alloy (such as bronze or brass), tin, tin alloy, aluminum, aluminum alloy, gold, nickel, and/or silver, as well as other conductive substances.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A connecting-conductor, comprising:

a first conductor-element having a first end and a second end;

a resistor-element having:

(a) an electrical-insulating substrate;

(b) a resistive material annularly disposed on at least part of the electrical-insulating substrate; and a second conductor-element having a first end and a second end;

wherein (i) the first end of the first conductor-element is mechanically-connected to the resistor-element and electrically-conductively connected to the resistive material; and (ii) the second end of the second conductor-element is mechanically-connected to the resistor-element and electrically-conductively connected to the resistive material; and (iii) the first conductor does not touch the second conductor; and (iv) an electrical pathway is created via the resistive material from one of the conductor-elements to the other of the conductor-elements; and (v) the resistor-element has a first surface defining a receiving-hole, and the first end of the first conductor-element or the first end of the second conductor-element resides in the receiving-hole; and (vi) the first conductor-element resides in the receiving-hole; and (vii) the resistor-element further comprises a second surface defining another receiving-hole in which the first end of the second conductor-element resides.

2. The connecting-conductor of claim 1, further comprising a conductive material that is:

(a) annularly disposed on at least part of the electrical-insulating substrate; and (b) electrically-conductively and mechanically-connected to one of the conductor-elements and to the resistive material.

3. The connecting-conductor of claim 1, further comprising a conductive material that is annularly disposed on at least part of the electrical-insulating substrate to provide a conductive pathway between the first conductor-element and the resistive material.

4. The connecting-conductor of claim 1, further comprising:

(a) a conductive material at a first location that is electrically-conductively and mechanically-connected to the first conductor-element and to the resistive material;

(b) a conductive material at a second location that is electrically-conductively and mechanically-connected to the second conductor-element and to the resistive material.

5. The connecting-conductor of claim 1, wherein:

(a) the first end of the first conductor-element has a surface defining a hole in which a first part of the resistor-element resides, and (b) the first end of the second conductor-element has a surface defining a hole in which a second part of the resistor-element resides.

6. The connecting-conductor of claim 1, wherein the electrical-insulating substrate is a ceramic material, a plastic material, or a polymer material.

7. The connecting-conductor of claim 6, wherein the electrical-insulating substrate is a material selected from the group consisting of: porcelain, alumina, steatite, titanate, and glass.

8. The connecting-conductor of claim 1, wherein the resistive material is selected from the group consisting of: carbon and a carbon composition.

9. The connecting-conductor of claim 1, wherein the first conductor-element or the second conductor-element is solid.

10. The connecting-conductor of claim 1, wherein the first conductor-element or the second conductor-element has a tubular portion.

11. A connecting-conductor, comprising:

a first conductor-element having a first end and a second end;

a resistor-element having:

(a) an electrical-insulating substrate;

(b) a resistive material annularly disposed on at least part of the electrical-insulating substrate; and a second conductor-element having a first end and a second end;

wherein (i) the first end of the first conductor-element is mechanically-connected to the resistor-element and electrically-conductively connected to the resistive material; and (ii) the second end of the second conductor-element is mechanically-connected to the resistor-element and electrically-conductively connected to the resistive material; and (iii) the first conductor does not touch the second conductor; and (iv) an electrical pathway is created via the resistive material from one of the conductor-elements to the other of the conductor-elements; and (v) the resistor-element has a first surface defining a receiving-hole, and the first end of the first conductor-element or the first end of the second conductor-element resides in the receiving-hole; and (vi) the receiving-hole extends through the resistor-element, and the first end of the first conductor-element resides in a first part of the receiving-hole, and the first end of the second conductor-element resides in a second part of the receiving-hole.

12. The connecting-conductor of claim 11, further comprising a conductive material that is:

(a) annularly disposed on at least part of the electrical-insulating substrate; and (b) electrically-conductively and mechanically-connected to one of the conductor-elements and to the resistive material.

13. The connecting-conductor of claim 11, further comprising a conductive material that is annularly disposed on at least part of the electrical-insulating substrate to provide a conductive pathway between the first conductor-element and the resistive material.

14. The connecting-conductor of claim 11, further comprising:

(a) a conductive material at a first location that is electrically-conductively and mechanically-connected to the first conductor-element and to the resistive material;

(b) a conductive material at a second location that is electrically-conductively and mechanically-connected to the second conductor-element and to the resistive material.

15. The connecting-conductor of claim 11, wherein:

(a) the first end of the first conductor-element has a surface defining a hole in which a first part of the resistor-element resides, and (b) the first end of the second conductor-element has a surface defining a hole in which a second part of the resistor-element resides.

16. The connecting-conductor of claim 11, wherein the electrical-insulating substrate is a ceramic material, a plastic material, or a polymer material.

17. The connecting-conductor of claim 16, wherein the electrical-insulating substrate is a material selected from the group consisting of: porcelain, alumina, steatite, titanate, and glass.

18. The connecting-conductor of claim 11, wherein the resistive material is selected from the group consisting of: carbon and a carbon composition.

19. The connecting-conductor of claim 11, wherein the first conductor-element or the second conductor-element is solid.

20. The connecting-conductor of claim 11, wherein the first conductor-element or the second conductor-element has a tubular portion.

21. A connecting-conductor, comprising:

a first conductor-element having a first end and a second end;

a resistor-element having:

(a) an electrical-insulating substrate;

(b) a resistive material annularly disposed on at least part of the electrical-insulating substrate; and a second conductor-element having a first end and a second end;

wherein (i) the first end of the first conductor-element is mechanically-connected to the resistor-element and electrically-conductively connected to the resistive material; and (ii) the second end of the second conductor-element is mechanically-connected to the resistor-element and electrically-conductively connected to the resistive material; and (iii) the first conductor does not touch the second conductor; and (iv) an electrical pathway is created via the resistive material from one of the conductor-elements to the other of the conductor-elements; and (v) the resistor-element has a first surface defining a receiving-hole, and the first end of the first conductor-element or the first end of the second conductor-element resides in the receiving-hole; and (vi) the first end of the first conductor-element resides in the receiving-hole; and (vii) the first end of the second conductor-element has a surface defining a hole in which part of the resistor-element resides.

22. The connecting-conductor of claim 21, further comprising a conductive material that is:

(a) annularly disposed on at least part of the electrical-insulating substrate; and (b) electrically-conductively and mechanically-connected to one of the conductor-elements and to the resistive material.

23. The connecting-conductor of claim 21, further comprising a conductive material that is annularly disposed on at least part of the electrical-insulating substrate to provide a conductive pathway between the first conductor-element and the resistive material.

24. The connecting-conductor of claim 21, further comprising:

(a) a conductive material at a first location that is electrically-conductively and mechanically-connected to the first conductor-element and to the resistive material;

(b) a conductive material at a second location that is electrically-conductively and mechanically-connected to the second conductor-element and to the resistive material.

25. The connecting-conductor of claim 21, wherein:

(a) the first end of the first conductor-element has a surface defining a hole in which a first part of the resistor-element resides, and (b) the first end of the second conductor-element has a surface defining a hole in which a second part of the resistor-element resides.

26. The connecting-conductor of claim 21, wherein the electrical-insulating substrate is a ceramic material, a plastic material, or a polymer material.

27. The connecting-conductor of claim 26, wherein the electrical-insulating substrate is a material selected from the group consisting of: porcelain, alumina, steatite, titanate, and glass.

28. The connecting-conductor of claim 21, wherein the resistive material is selected from the group consisting of: carbon and a carbon composition.

29. The connecting-conductor of claim 21, wherein the first conductor-element or the second conductor-element is solid.

30. The connecting-conductor of claim 21, wherein the first conductor-element or the second conductor-element has a tubular portion.

* * * * *